US008550130B2

(12) United States Patent
Burrows

(10) Patent No.: US 8,550,130 B2
(45) Date of Patent: Oct. 8, 2013

(54) APPARATUS AND METHOD FOR REFILLING REUSABLE CONTAINERS

(76) Inventor: Martin John Burrows, South Haven, MI (US)

( * ) Notice: Subject to any disclaimer, the term of this patent is extended or adjusted under 35 U.S.C. 154(b) by 219 days.

(21) Appl. No.: 13/199,420

(22) Filed: Aug. 30, 2011

(65) Prior Publication Data

US 2012/0111441 A1 May 10, 2012

Related U.S. Application Data

(60) Provisional application No. 61/411,986, filed on Nov. 10, 2010.

(51) Int. Cl.
*B67C 3/26* (2006.01)

(52) U.S. Cl.
USPC ..... 141/284; 141/1; 141/9; 141/101; 141/104

(58) Field of Classification Search
USPC ..... 141/1, 9, 100, 101, 104, 279, 284; 222/478
See application file for complete search history.

(56) References Cited

U.S. PATENT DOCUMENTS

| | | | | |
|---|---|---|---|---|
| 4,844,298 | A * | 7/1989 | Ohoka et al. | 222/58 |
| 4,929,818 | A | 5/1990 | Bradburry et al. | |
| 6,387,330 | B1 * | 5/2002 | Bova et al. | 422/509 |
| 6,578,763 | B1 | 6/2003 | Brown | |
| 6,672,344 | B1 * | 1/2004 | Stokes et al. | 506/40 |
| 6,742,549 | B1 * | 6/2004 | Feygin et al. | 141/9 |
| 7,065,940 | B2 | 6/2006 | Dudek et al. | |
| 7,571,586 | B1 | 8/2009 | Morales | |
| 7,967,037 | B2 * | 6/2011 | Foster et al. | 141/104 |
| 2002/0066493 | A1 | 6/2002 | Hewlitt et al. | |
| 2003/0230355 | A1 * | 12/2003 | Bartholomew et al. | 141/104 |
| 2008/0196787 | A1 * | 8/2008 | Comstock et al. | 141/9 |

* cited by examiner

*Primary Examiner* — Jason K Niesz
(74) *Attorney, Agent, or Firm* — Joseph K. Andonian

(57) ABSTRACT

An apparatus and a method for filling reusable containers employing a plurality of moveable spigots located in a planar rectangular arrangement inside two frames positioned to move back and forth on X and Y axes to position a selected spigot over the open top of a reusable container.

15 Claims, 3 Drawing Sheets

APPARATUS AND METHOD FOR REFILLING REUSABLE CONTAINERS

This application claims the benefit under 34 U.S.C. 119(c) of provisional application No. 61/411,986 filed Nov. 10, 2010 entitled "Liquid pump machine for refilling disposable bottles".

This invention relates to an apparatus and method for filling a reusable container employing multiple movable spouts located in the same plane each spout being devoted to dispensing a distinct fluid.

BACKGROUND OF INVENTION

There was a period in our economic development when we commonly used reusable containers to dispense such commonplace consumer products such as milk and petroleum products such as gasoline and oil. As our convenience became more important and technology permitted we turned to low cost disposable containers often utilizing plastic materials. This created a different problem, namely overloading landfills with plastic materials, bottles and cans that were often not biodegradable. The inconvenience and associated cost of disposal of disposable containers has led to the use of technology to develop machines for filling reusable containers.

U.S. Pat. No. 4,929,818 is an example of a method and apparatus for refilling reusable containers that also summarizes the patent art prior to its filing date including U.S. Pat. Nos. 4,180,284, 4,007,462 and 3,711,683. The focus of these patents is on reading the bar code indicia on the label of the containers. Pub. No.: 2002/0066493 is another example of a machine for filling a reusable container but the emphasis is on filling a collapsible container with a single product from a single spout. U.S. Pat. No. 6,578,763 is still another example of a machine for filling a reusable container but the focus is on mixing ingredients and dispensing them through a single spout. U.S. Pat. No. 7,065,940 is focused on a delivery system for delivering bulk products ultimately to fill reusable containers but does not disclose how the vending machines employed actually function. While these patents all disclose useful technology for filling reusable containers, none of these patents disclose or suggest machines or methods for delivery of several different fluid products from a single machine to a reusable container using multiple spouts or spigots. More specifically, they do not disclose or suggest an apparatus or method for delivering multiple and different products without contamination by using multiple movable spouts.

Throughout this specification the words nozzle, faucet, spout and spigot are used interchangeably to signify a fixture suitable for delivering a fluid through a pipe or tube from a bulk container to the open top of a reusable container.

Most broadly, the present invention comprises a machine and a method for filling reusable containers having an open top with a fluid comprising a. A plurality of movable spouts located in a rectangular pattern in the same plane,
b. A single station for positioning a reusable container securely, and
c. Control means for positioning one of the movable spouts over the open top of the container and filling the container with a selected quantity of a selected fluid.

BRIEF SUMMARY OF INVENTION

Disclosure of Invention

This invention addresses the problem of disposing of containers that are not biodegradable by reverting back to the use of reusable containers but does so in a more convenient and economical manner while reducing the possibility of cross contamination. For example, the present invention achieves greater economy by dispensing several different products from a single machine without contaminating the spout through which the fluid is delivered. Thus a single machine can deliver detergents through one spout and food products through another spout, albeit laws may prohibit the delivery of chemicals and food products by the same machine. A single machine can also deliver several grades of a single product such as an automobile oil or a household detergent. A single machine can deliver several types of milk with different contents of fat or lactose. Moreover a machine can deliver a product as a liquid or a powder with the spouts, connections and pumps being adapted to dispense products with such varying flow characteristics. Machines adapted to deliver liquids are preferred. Greater economy is achieved for the manufacturer or marketer because bulk manufacture and delivery is more economical than packaging and delivering small packages. Greater economy is achieved by a retailer because a single machine can deliver multiple products. Greater economy is achieved for the customer because he can use the same container several times and he can select the quantity of product he wishes to purchase within the capacity of the container. Greater economy and convenience is achieved for all concerned because there will be far fewer containers to manufacture, fill, ship, store, shelve and dispose.

A typical embodiment of the present invention is a vending machine capable of dispensing four liquid or powdered products in varying quantities into a disposable container placed in a secure nesting position provided in the machine. The nest positions the container securely under the universal position for a spigot or faucet selected by a customer from one of the four movable spigots. The spigots are individually connected by tubing to bulk containers positioned inside the machine. Computerized controls in the machine position the spigot connected to the bulk container for the product selected by the customer using a touch screen on the front of the machine. The touch screen enables the customer not only to select the product he wants but also the quantity he wants. Pumps are employed to transfer the selected product from the bulk containers to the spigots. The machines can provide a bill with a bar code to identify the product and the quantity dispensed by the machine. The bill is presented for payment or screened when the customer checks out of the store where the vending machine is located. Alternatively the machine can provide a cash or credit card accepter followed by change, if necessary, and/or a receipt. The most novel feature of the machine is the mechanism by which the selected spigot is positioned to fill the disposable container.

The type of machine housing the apparatus of the present invention is not critical as long as it is capable of housing the apparatus for positioning the spigot for delivering the selected product to the reusable container. Neither are the number of spigots or associated bulk fluid containers, albeit the principal advantages are realized if they are present in multiple quantities and located at right angles to each other, for example 4 or 6 but could be as high as 50. Computerized controls activated by a touch screen are preferred. Cash or credit card payment options and/or a bill or bar code for subsequent payment on checkout are all feasible additions to the machine. The type of nest employed to position the open top of a disposable container securely to assure that the open top is positioned in the proper location is not critical. A simple indentation in the platform on which the bottom of the container rests is sufficient. The platform can be perforated or shaped to allow spillage to drain into a waste container. If desired, casters can be located on the corners under the vending machine to enable a store operator to move the machine to a location where the bulk containers can more conveniently be filled or loaded in the machine.

While other machines dispense several different fluids, they deliver a selected fluid through a single nozzle or spigot which invites cross contamination and may even require cleaning and/or sterilization every time a different fluid is dispensed. The present invention allows greater flexibility in the fluids dispensed by a single machine at low expense with less risk of contamination.

The novel mechanism by which a selected spigot is positioned over the open top of a reusable container comprises a first or primary rectangular frame or carriage and a second smaller or secondary rectangular frame or carriage located in the same plane. The secondary frame contains the spigots affixed in a rectangular pattern in the center of the frame also in substantially the same plane as the frames, and moves as unit in one or a Y direction inside the primary frame or carriage that moves in a different or X direction perpendicular to the secondary frame. A programmed control mechanism moves the frames in a coordinated fashion to position the spigot that can deliver the selected fluid in the proper position so a pump can deliver the selected fluid into the open top of a reusable container. The primary frame moves on the X axis along parallel shafts over linear bearings on opposite sides of the frame. The secondary frame moves on the Y axis along parallel shafts over linear bearings that are located opposite each other along the remaining two sides of the primary frame. An electrically, pneumatically or mechanically powered piston moving in and out of a cylinder can be employed to move the frames back and forth but any means for moving the frames back and forth perpendicular to each other would be suitable. Properly located switches and flags that trip the switches on or off can be employed to inform the programmed control mechanism when the selected spigot is properly located to dispense the fluid into the open top of the reusable container.

LIST OF REFERENCE NUMERALS

Figure 1:
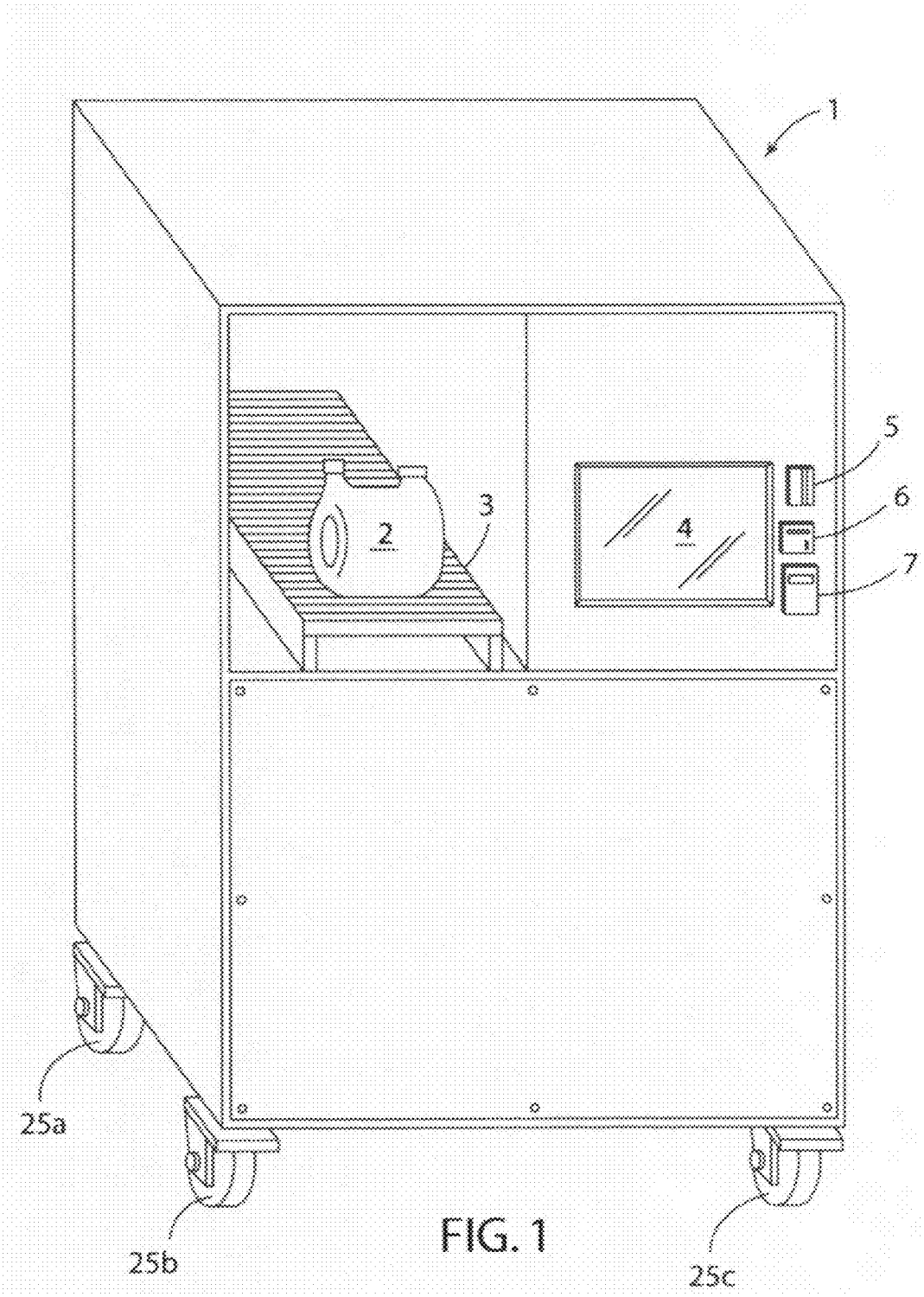
FIG. 1 is a perspective view of a vending machine for filling a reusable container.

1 Vending machine for filling reusable containers
2 Reusable container
3 Platform for positioning reusable container
4 Touch screen for selecting a fluid
5 Credit card swipe
6 Cash receiver
7 Receipt dispenser
8 Primary carriage or frame
9 Secondary carriage or frame
10 Prox switch for secondary carriage
11 Prox switch for primary carriage
12 Mechanism to position primary carriage
13 Mechanism to position secondary carriage
14*a,b,c,d* Linear bearings for primary carriage
15*a,b,c,d* Linear bearings for secondary carriage
16*a,b,c,d* Spigots
17*a,b* Flags to indicate the position of the primary carriage
18*a,b* Flags to indicate the position of the secondary carriage
19*a,b* Shafts for primary carriage
20*a,b* Shafts for secondary carriage
25*a,b,c* Casters

DETAILED DISCLOSURE OF INVENTION

Best Mode of Carrying Out Invention

A preferred embodiment of the present invention can be assembled by those skilled in the art of producing vending machines using standard methods of manufacture. A preferred embodiment of such a vending machine 1 is shown in FIG. 1 suitable for dispensing one of four bulk fluids (a liquid or a powder) selected by a customer using a programmed touch screen 4, a credit card swipe 5, cash payment with a change dispenser 6 and a receipt dispenser 7. Although the present mechanism will work with as few as three spigots located at right angles to each other, the greatest advantages will be obtained with four or more spigots arranged in a rectangular pattern. Provision can also be made for printing a bill for payment on check out (not shown). The machine can be built out of stainless steel, aluminum or any other metal of like strength and durability. A suitable size for a four spigot machine would be about 6 foot high and about 4.5 foot square, to accommodate reusable containers 2 measuring about 4×10×12 inches and four reusable bulk containers (not shown) with the same dimensions as 55 gallon drums. Pumps (not shown) are used to transfer the fluids from the bulk containers to the spigots 16*a,b,c,d*, best shown in FIG. 2. The pumps and bulk containers can also be located outside the machine. The four spigots 16*a,b,c,d* would typically be located in a rectangular pattern 3 inches apart. The back would provide an opening (not shown) to fill or replace the bulk containers. Four caster mounts are welded on four legs on the four corners underneath the machine and four casters 25*a,b,c* are mounted thereon (details not shown). The touch screen 4 is mounted on an electrical box (not shown) which, in turn, is mounted on the front of the machine 1.

Typical of fluids that can be dispensed by the vending machine are various grades and types of detergents in liquid or powdered form, for example with and without bleach. Fruit and vegetable juices are other examples. Still other examples are automotive oils that come in various grades and viscosities.

Figure 2:
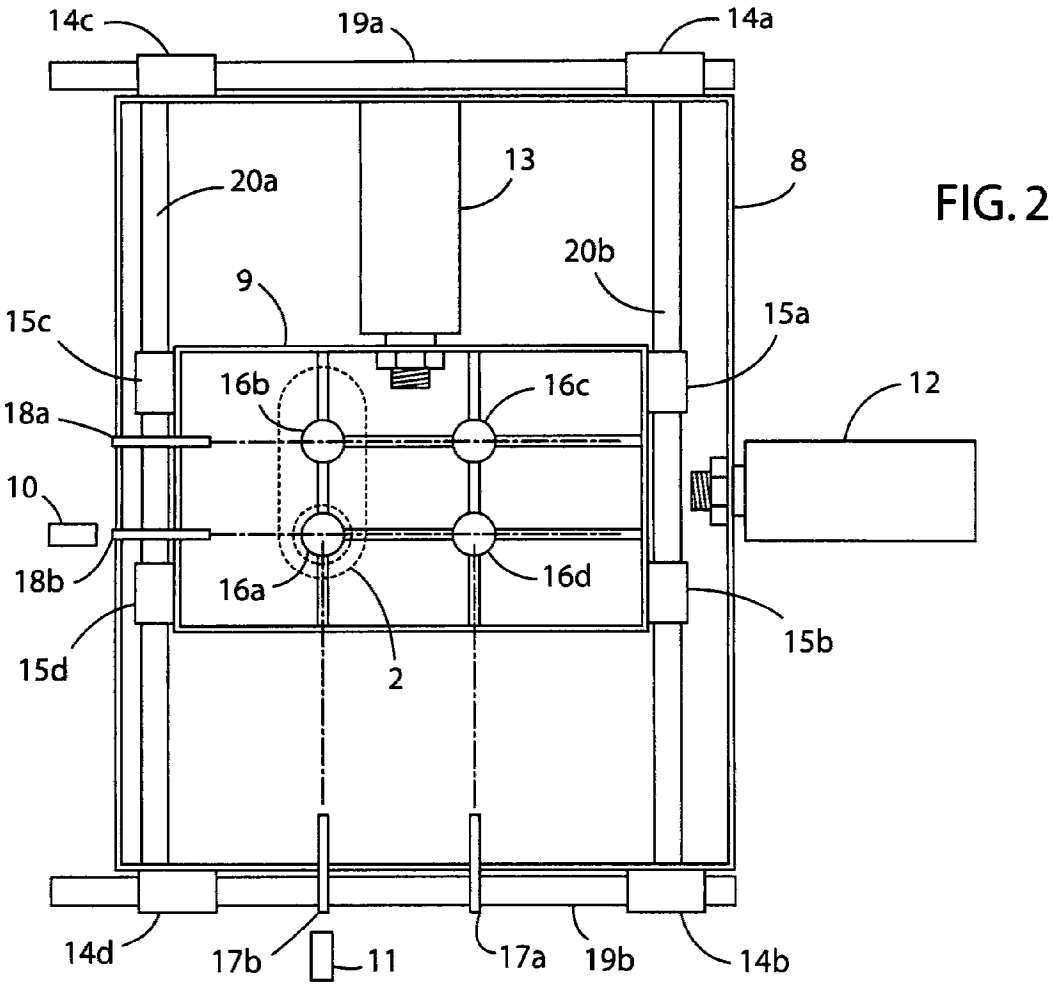
FIG. 2 is a top view of the mechanism inside the apparatus for positioning one of four nozzles for dispensing a fluid into the container.
Figure 3:
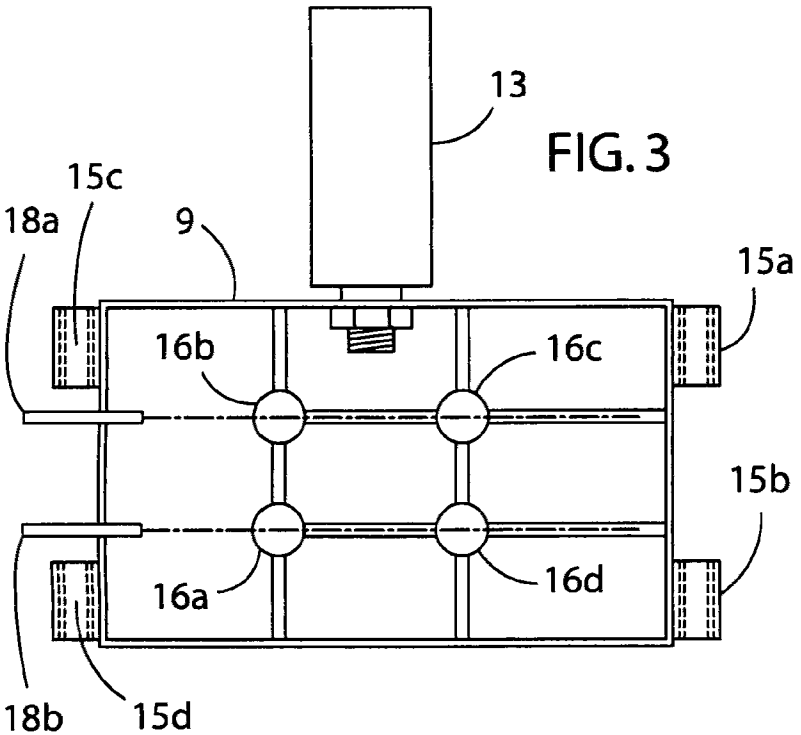
FIG. 3 is a top view of the secondary carriage or frame that contains the four nozzles.
Figure 4:
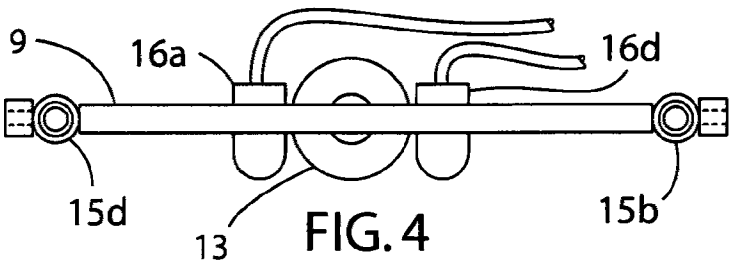
FIG. 4 is a front view of the secondary carriage.
Figure 5:
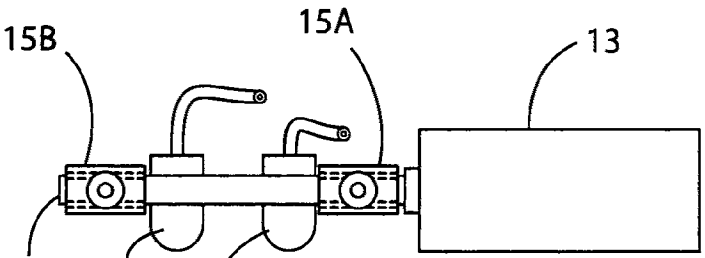
FIG. 5 is a side view of the secondary carriage.

The platform 3 shown in FIG. 1 is large enough to accommodate the reusable container 2 securely in a location that positions the open top of an empty container 2 under nozzle 16*a* (best shown in FIG. 2) capable of dispensing the selected fluid into the container 2. The preferred touch screen 4 is programmed to allow the customer to select a specific quantity of the selected fluid up to the capacity of a standard reusable container 2 originally provided by the retailer where the vending machine 1 is located. The nozzle that delivers the selected fluid is connected by piping (partial segments shown in FIGS. 4 and 5) to a large storage tank (not shown) located either in the vending machine 1 or in a separate location. The machine 1 would preferably contain 4 or more nozzles 16*a,b,c,d* capable of movement to position the selected nozzle over the open top of the container 1. Movement is achieved by locating the nozzles 16*a,b,c,d* in the same plane inside a secondary carriage or frame 9, three views of which is shown in FIGS. 3, 4 and 5, is capable of movement inside a larger primary carriage or frame 8, the combination of which is best shown in FIG. 2. The frames 8,9 move perpendicular to each other, i.e., as depicted the secondary frame 9 moves along the Y-axis while the primary frame 8 moves along the X-axis. As shown movement is powered electrically or pneumatically by separate pistons located inside cylinders 12,13 and positioned to move the frames 8,9 in the pictured manner. Thus coordinated movement of the two frames 8,9 can position the desired nozzle over the open top of the container 1. The primary frame 8 is mounted on linear bearings 14*a,b,c,d* that move along shafts 19*a,b* located parallel to the X-axis while the secondary frame 9 (best shown in FIGS. 3, 4 and 5) is mounted on linear bearings 15*a,b,c,d* that move along shafts 20*a,b* located parallel to the Y-axis inside the primary frame 8. Prox switches 10,11 are provided for each frame 8,9 and flags 17*a,b* for the primary frame 8 and 18*a,b* are provided for the secondary frame 9 to trip the switches 10,11 and position the nozzles 16*a,b,c,d* in the desired positions.

A machine embodying the present invention can include a safety door (not shown) over the opening for gaining access to the space provided for nesting the reusable container 2. A bar code reader (not shown) can be mounted alongside the nesting position to make sure the correct fluid goes into the correct container 2. A plate (not shown) can be mounted to the main frame of the machine under the spigots 16*a,b,c,d* with a hole over the top of the filling position to catch any dripping from spigots 16*a,b,c,d* when not in use. Flow control valves (not shown) in the spigots 16*a,b,c,d* can be connected to individual meters (not shown) to report to the computerized controls how much fluid is being transferred into the containers 2. The bulk containers (not shown) can contain check valves or related mechanisms (not shown) to prevent back flow.

The present invention has been described in preferred embodiments that are not intended to be limiting. Various alterations and modifications will be readily apparent to those skilled in the art after reading the present disclosure. The scope of the invention should therefore be limited only by the scope of the claims appended hereto.

The invention claimed is:

1. A machine for filling reusable containers having an open top with a fluid, the machine comprising a. A plurality of movable spigots located in a rectangular pattern in the same plane, b. A single stationary station for nesting a reusable container securely, and c. Control means for positioning one of the movable spigots rectilinearly over the open top of the container and filling the container with a selected quantity of a selected fluid.

2. The machine of claim 1 further comprising a. Four movable spigots arranged in a planar rectangular pattern, b. Means for moving the spouts within the plane occupied by the spigots in two directions perpendicular to each other and thereby position a selected spout over the open top of the container located in the station.

3. The machine of claim 2 further comprising a. A first rectangular frame adapted to move back and forth within the plane occupied by the spouts in one direction, b. A second rectangular frame located inside the first frame adapted to move back and forth within the plane in a direction perpendicular to the direction of movement of the first frame, the four spouts being centrally affixed in the second frame, Whereby combined movement of the frames positions a selected spigot over the open top of the container.

4. The machine of claim 1 wherein the machine comprises a machine for vending the refilled container directly to and in the presence of a customer.

5. The machine of claim 1 further comprising a liquid fluid.

6. The machine of claim 1 further comprising a plurality of bulk containers capable of providing sufficient quantities of the fluid for filling reusable containers.

7. The machine of claim 1 further comprising pumps adapted to deliver fluid from bulk containers through piping to the spigots.

8. An apparatus for positioning a spigot to deliver a fluid into the open top of a container, the apparatus comprising a. A first movable rectangular frame, b. A second movable rectangular frame sized and positioned to fit inside the first frame, c. The second frame having a minimum of four spigots centrally located in a rectangular pattern inside the frame, d. The frames and spigots all being functionally located in a single plane, e. Programmed control means for moving the frames separately in directions perpendicular to each other and thereby locating a selected spigot into a position suitable for filling the container.

9. The apparatus of claim 8 further comprising back and forth movement of the frames is facilitated by pneumatically or electrically powered pistons that move the frames over linear bearings mounted on parallel shafts.

10. A method for delivering a quantity of a fluid selected by a person to a reusable container having an open top which comprises the steps of a. Providing a secure nest to place the reusable container in a bulk filling machine, b. Providing programmed control means for a person to designate the amount of a fluid the person wants delivered to the reusable container and thereby activating an apparatus installed in the machine comprising 1. multiple movable spigots installed in a central location in a rectangular pattern inside a rectangular frame moving along an Y axis inside a second rectangular frame moving along a X axis, said frames and spouts being located in the same plane, and 2. a pump to deliver the selected quantity of the fluid from a bulk container containing that fluid to a selected spigot connected by piping to the bulk container and positioned by coordinated movement of the frames over the open top of the reusable container.

11. The method of claim 10 further comprising the fluid is a liquid.

12. The method of claim 10 further comprising the fluid is a powder.

13. The method of claim 10 further comprising the pumps and bulk containers are located outside the machine.

14. The method of claim 10 further comprising the spigots are four in number.

15. The method of claim 13 further comprising the machine is a vending machine.

* * * * *